US005989113A

United States Patent [19]

Arnold

[11] Patent Number: 5,989,113

[45] Date of Patent: Nov. 23, 1999

[54] TOOL FOR MECHANICAL SURFACE TREATMENT

[75] Inventor: Théo Arnold, Oderen, France

[73] Assignee: Heinrich Lippert GMBH, Epfenbach, Germany

[21] Appl. No.: 08/809,227

[22] PCT Filed: May 24, 1995

[86] PCT No.: PCT/EP95/01978

§ 371 Date: Mar. 18, 1997

§ 102(e) Date: Mar. 18, 1997

[87] PCT Pub. No.: WO96/09915

PCT Pub. Date: Apr. 4, 1996

[30] Foreign Application Priority Data

Sep. 26, 1994 [DE] Germany ..... 94 15 441 U
Oct. 26, 1994 [DE] Germany ..... 94 17 186 U

[51] Int. Cl.[6] ..... B24D 11/00

[52] U.S. Cl. ..... 451/532; 451/533; 451/526

[58] Field of Search ..... 451/532, 526, 451/904, 921, 533; 15/230.12, 230.15

[56] References Cited

U.S. PATENT DOCUMENTS

| | | | |
|---|---|---|---|
| 1,529,701 | 3/1925 | Hewitt . | |
| 3,122,766 | 3/1964 | Peterson | 451/532 |
| 3,597,887 | 8/1971 | Hall, Jr. | 451/532 |
| 3,991,526 | 11/1976 | Frank et al. | 451/532 |

FOREIGN PATENT DOCUMENTS

| | | |
|---|---|---|
| 0 178 577 | 4/1986 | European Pat. Off. . |
| 234 655 | 5/1911 | Germany . |
| 1 427 586 | 12/1968 | Germany . |
| 69 32 770 | 8/1969 | Germany . |
| 2 218 295 | 10/1973 | Germany . |
| 88 10 629 | 11/1988 | Germany . |
| 37 17 204 | 12/1988 | Germany . |
| 39 38 578 | 6/1990 | Germany . |
| 41 09 692 | 9/1992 | Germany . |

*Primary Examiner*—David A. Scherbel
*Assistant Examiner*—Derris Holt Banks
*Attorney, Agent, or Firm*—Wenderoth, Lind & Ponack, L.L.P.

[57] ABSTRACT

A tool for a mechanical surface treatment of an object by friction is disclosed. The tool is cut to a desired shape and size from a processed fleece of fibers. The fleece is produced by exclusively mechanical processes as a flexible random-fiber fleece which permits, during the treatment of the object at a particular treatment pressure, immersion and at least partial envelopment of the object within the fleece. The fleece has a mechanical strength of 150–500 N/50 mm, preferably at least 300 N/50 mm, and a mean elongation at rupture of 50–150%, preferably 80–100%, according to DIN 53 857/2.

25 Claims, 4 Drawing Sheets

TOOL FOR MECHANICAL SURFACE TREATMENT

BACKGROUND OF THE INVENTION

The invention relates to a tool to be implemented as a grinding ring or grinding disk for the mechanical surface treatment by friction of an object. For example, the tool may be used for brushing, polishing, shining, cleaning, wetting or drying. The tool includes a cut and processed fleece of fibers.

The mechanical surface treatment is used for working numerous products including metal, wood, stone, glass, leather, synthetic material and the like, such as for example kitchen utensils, flatware, instruments, armatures, notches, grooves, frames of doors, windows, profile rods, industrial parts, jewelry and musical instruments as well as for the maintenance and care of floors, walls, glass panes, tiles and the like.

In polishing, the surface treatment is implemented in several steps with the graduated use of different tools or tool configurations which generate an increasingly finer surface. These tools include polishing rings or disks which are composed of several layers of woven textiles and in general are disposed on a common axis of rotation on a clamping ring. For polishing rings, the textile is cut into strips, folded, and fastened annularly about a core comprising cardboard rings, flanges or a metal clamping ring. For polishing disks, layers of textiles are cut to size, placed one above the other and rotated by an angle of 30°, and sewn and held together by cardboard flanges affixed thereon. The textile used for this purpose is in general, but for polishing in particular, a cotton textile. Except in the earlier polishing procedures, a textile having more rigid fibers, for example sisal, can also be used. Specific polishing rings or disks, can also be fabricated from a mixture of cotton and sisal textile. The polishing rings and disks, can be impregnated with a resin serving as a bonding means to increase the strength of the tool.

It has been necessary for many years to bias textiles comprising cotton or other nonmixed or mixed fiber materials before cutting them to size and processing them into folded rings. Biasing aligns the warp and weft threads so that they extend obliquely to the selvedge and thus prevents fraying. For this procedure a special reversing machine is required which sews the edges of the textile together thus forming a tube. Subsequently the textile tube is helically cut open into webs (biased) and rolled up to form bales. The threads form an angle of 45° at the periphery of the folded rings. The problem of fraying of the folded rings is intended to be counteracted by means of the biasing (cf. Journal L'Usine Nouvell, March 1961, "Techniques modernes de Bufflage et de Pollisage").

By folding pleats into the textile strips, the polishing ring is automatically ventilated during rotation and receives the requisite pliability to envelope or wrap the part to be polished and forms honeycombs at the periphery which hold the polishing paste. Polishing pastes due to their grinding and lubricating capability are always required when polishing surfaces.

Conventional polishing tools, however, have economic as well as technical disadvantages. These are in particular the following:

- impeded procurement of goods on the world markets due to bureaucratic regulation of import quotas by the European Union with respect to cotton textiles,
- strong fluctuations of the quotations on the stock market of world market prices of the raw material cotton,

- lacking production capacities in Europe due to high wages,
- difficult manufacture of mixed textiles due to the yarn production process,
- technical necessity of biasing as an additional work step which cannot be automated which results in disturbing side effects of hard and broad bias seams which impair the production process as well as the quality of the surface treatment,
- considerable textile waste,
- non-uniform wear of the grinding rings and disks due to fraying of the textile,
- frequent tool change due to limited service life of the grinding rings and disks.

Polishing tools composed of fleece are rarely used. FR 1 426 721 describes in this regard, for example, a polishing or grinding material comprised of fleece which comprises permanently undulated synthetic filaments. In the process, an adhesive substance with or without grinding particles is applied onto the filaments held in tension. When the tension is relaxed the fibers become interlaced and are subsequently thermofixed. The fleece obtained in this way is cut into an annular polishing tool and processed. FR 2 310 838 also discloses polishing rings which comprise several layers of fleece. The nonsystematically arranged fibers of this fleece are connected at their points of intersection by means of a resin.

In spite of some improvements to textile rings and disks, such fleece polishing rings and disks nevertheless still have the following disadvantages:

- high waste component which cannot be utilized due to the bonding means,
- low fleece density due to the limited penetration capability of the bonding means (filter effect),
- insufficient mechanical strength and lower service life,
- limited possibilities of application because of non-uniform distribution of the bonding means and consequent erratic results,
- insufficient heat stability leading to undesirable smearing effect,
- restricted production capability of fiber mixtures due to differing adhesion and bonding capability of the bonding means on the different types of fiber materials, and
- undesirable stiffening of the fibers through the bonding means.

EP-A-0 178 577 discloses a felt body, in particular a felt ring, provided with grinding or polishing paste for polishing and grinding work. In addition, the body comprises at least 35% wool or similar hair elements to facilitate the integration of the grinding and polishing grains into the felt. Also grinding and polishing grains of a grain size less than 1000 $\mu$m are enclosed in hollow spaces of the random-fiber felt. The felt body is treated with a stiffening means with the fraction of stiffening additives to the felt body being at least 40%. As stiffening additives, water-soluble thermoplastic additives with a dry content of 20 to 50% polyvinyl acetate dispersions are used. The resulting stiffness of the felt body makes it unsuitable for many applications.

SUMMARY OF THE INVENTION

It is an object of the present invention to create a tool of the above described type which, while avoiding the previously cited disadvantages, has reliable applicability, in particular for objects with uneven surfaces, while being simple to manufacture and having a long service life.

This task is solved in a tool according to the present invention by utilizing a fleece produced by exclusively mechanical processes as a flexible random-fiber fleece which permits the immersion and at least partial envelopment of the object while under a normal treatment pressure, with a mechanical strength of 150–500 N/50 mm, preferably at least 300 N/50 mm, and a mean elongation at rupture of 50–150%, preferably 80–100%, according to DIN 53 857/2.

The manufacturing is free of bonding means, since application of such means would lead to a stiffening of the fibers thus impairing the flexibility of the fleece.

Hence a significant technical and economic advance in the field of surface treatment by friction is achieved. Tools according to the invention entail the following advantages:

- independence from unstable raw material prices since the fleece according to the invention can also be produced by using artificial or synthetic fibers,
- reusable waste since neither a textile structure nor bonding means are present,
- expanded options for fiber mixing since yarn production is omitted,
- omission of the working step of biasing,
- better processibility and application capability due to the omission of bias seams,
- production processes which are simple to automate,
- no fraying and thus uniform radial wear,
- consequently greater service and thus tool change times,
- increased quiet running due to better true running,
- readily removable abraded particles and thereby greater cleanliness and reduced danger of smoldering fire at the work place, and
- due to the flexibility of the bonding means-free and therefore not rigid random fiber fleece, good immersion behavior for uneven objects which upon immersion are enveloped by the fleece. The flexibility is preferably such that an immersion depth of up to at least 50 mm can be achieved.

Depending on the requirements and consumption, the grinding and polishing paste can be added separately during the surface treatment. In addition, the necessity of keeping the grinding and polishing grains in the fiber fleece may become superfluous.

Flexibility and immersion behavior of the tool can be further optimized so that the random-fiber fleece has a dropping capability, i.e. a drop coefficient D according to DIN 54 306 between approximately 70 and 90%.

In an advantageous embodiment of the invention the mechanical fleece formation process is carried out either through a known needling process or by means of a liquid and/or gas jet whereby a surprisingly durable random-fiber fleece, especially suitable for the application purpose according to the invention, is generated, which meets the requirements of a tool for the mechanical surface treatment by friction especially well while having a long service life.

In the jet, water is preferably used as the liquid and air is preferably used as the gas. As is also the case with the needle technique, both methods lead to a bonding means-free fiber composite. Furthermore, the use of water as the liquid entails the advantage that the water completely evaporates during drying.

The fibers forming the fleece can be natural, artificial or synthetic and can be present in the fleece mixed or not mixed. Possible natural fibers of plant origin include cotton, linen, hemp or sisal. Possible natural fibers of animal origin include wool mohair and silk. Possible artificial fibers include viscose, mineral, ceramic, carbon and metal fibers. Possible synthetic fibers include those comprising polyester, polyamide, polypropylene, polyimide, acrylic and aramide. Fibers which are filled with mineral substances have additional advantages. For example, the wear of the material can be improved. Through the abrasive action of such fibers, the polishing effect of the fleece is influenced positively.

According to a further characteristic of the invention, the fleece includes a fraction of bond fibers connected at their crossing points under the influence of heat. Hence, a further mechanical strengthening of the fiber structure is achieved without needing to use a liquid curable bonding means which would lead to an undesirable stiffening of the fibers. Through such thermofixation the flexibility of the individual fibers is not impaired. The bond fibers have a lower melting point than the remaining fibers.

When using a fraction of shrink fibers which contract under the influence of heat and remain in this state even after cooling, additional densification of the fiber structure and a concomitant increase of the mechanical strength can be attained.

Preferably cross-cut fibers having a length between approximately 10 and 100 mm and a titer between approximately 0.02 and 150 dtex are used.

Furthermore, within the scope of the inventive concept, an ideal density and thickness of the fleece in the fleece forming process is achieved if a liquid jet stream having a pressure between approximately 5 and 230 bars is used.

The nozzles generating the liquid jet used for the fleece production preferably have a diameter between approximately 80 and $140\times10^{-6}$ m.

The fleece furthermore has preferably a mass per area (grams per square meter) between approximately 50 and 500 $g/m^2$ and a thickness between approximately 0.3 and 5 mm.

The fleece can be implemented for example as a folded ring, flat disk, pad, roll, cylinder, tape or brush in order to meet specific application requirements.

As a folded ring the fleece can have the form of a ring which comprises at least one strip cut to size from at least one fleece layer, which is folded, and secured radially about a solid core.

It is also possible that the fleece in the form of a ring comprises at least one strip cut to size from at least one layer of fleece, which is folded in the form of waves and secured about a solid core.

Another alternative includes fleece in the form of a ring comprising at least one strip cut to size from at least one layer of fleece, which is folded and/or gathered and held together by a central clamping ring.

It is also possible that the fleece in the form of a ring comprises at least two disks cut to size from at least one layer of fleece, placed one on top of the other, and held together by center pieces and/or through quilting.

Where the use of disk-shaped or annular tools is not suitable, the folded fleece can be secured on a belt-form continuous carrier, for example a driving belt, drivable by one or several pulleys. The fleece in the form of individual single or multi-layered strip segments formed into leaves is secured on the belt-form continuous carrier.

In order to adapt the tool for varying application purposes, it is further suggested that the finished and potentially already mounted fleece be provided with substances for the purpose of reducing the wear or flammability or for the purpose of improving the paste adhesion, the abrasive behavior, the surface attack, service life, absorption of liquid, capability to repel liquids, antistatic effect or the like, without significant change of the mechanical bonding of the fibers in the fleece.

Further goals, characteristics, advantages and application possibilities of the invention are evident in the following description of embodiment examples in conjunction with the drawings. Therein all described and/or graphically represented characteristics by themselves or in any combination form the subject matter of the invention even independently of their summary in the claims.

DETAILED DESCRIPTION OF THE INVENTION

Figure 1:
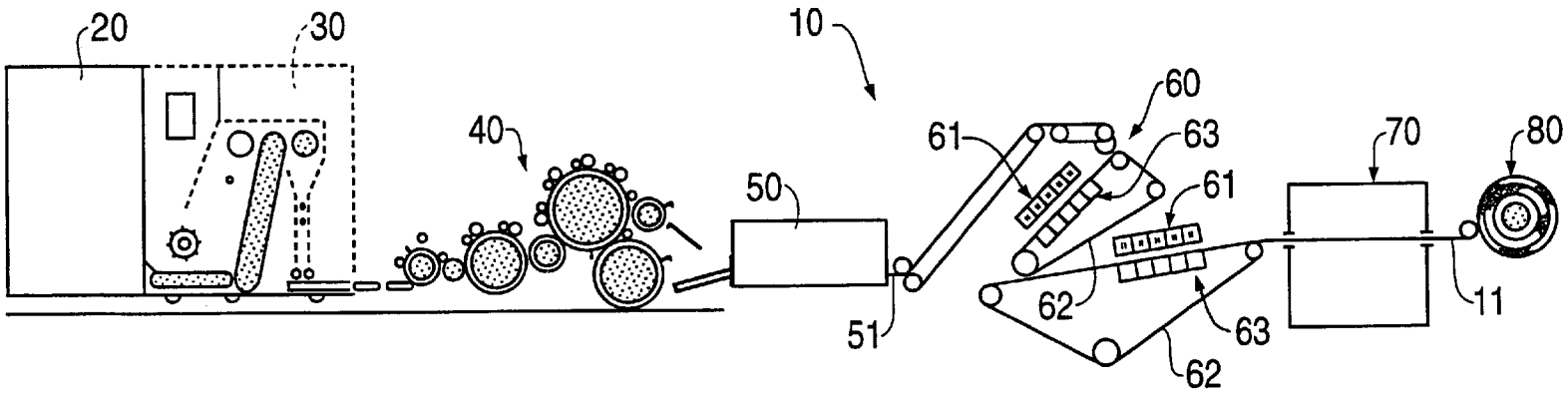
FIG. 1 an example of a manufacturing process for a fleece according to the invention, FIGS. 2*a* to 2*d* perspective views of different embodiments of polishing rings and disks, FIG. 2*e* a perspective view of a polishing ring with leaves, FIGS. 2*f* and 2*g* a perspective view of belt-form tools, FIG. 3*a* a perspective view of a used conventional polishing ring, FIG. 3*b* a perpective view of a used polishing ring of the instant invention, FIG. 4*a* a perspective view of a used conventional disk-form tool, and FIG. 4*b* a perspective view of a used disk-form tool of the instant invention.

According to FIG. 1, a production line 10 for a fleece 11 according to the invention, produced free of bonding means through liquid jets, includes: an opener with mixing chamber 20 for fiber balls for the production of a loose homogeneous bulk material, a weighing dosing device 30, a carding machine 40, a spreading machine 50, a jet installation 60 for the mechanical bonding of the fibers to form a random-fiber fleece 11, a drying oven 70 and a winder 80. In the case of a production line operating according to the needling process, a needle machine is used instead of the jet installation 60.

The fiber bales are opened in the opener 20. These are preferably cross-cut fibers of a natural, artificial or synthetic type with a length between approximately 10 and 100 mm and a titer between approximately 0.02 and 150 dtex. The opener 20 with its adjoining mixing chamber can process fibers of the same or of a different type. In the mixing chamber, identical fibers can be produced in homogenized form. In addition, mixtures of different fiber types can also be produced. Accordingly, one or several identical bales or several nonidentical bales are used.

The weighing dosing device 30 supplies the carding machine 40 which converts the loose fibers into a card web. Furthermore, the fibers in the card web are aligned in the same direction. The mass per area of the card web is given and regulated by the quantity of the fibers supplied by the weighing dosing device 30. This can vary for example between approximately 5 and 10 g/m$^2$. The card web is subsequently arranged in layers on a conveyor belt by the spreading machine 50, thus forming a fiber fleece 51. The mass per area of the fiber fleece 51 is between approximately 50 and 500 g/m$^2$. The fiber fleece 51 subsequently passes through the jet installation 60, or alternatively the needle machine, for the production of a random-fiber fleece 11 free of bonding means. The liquid jet process is more cost-effective up to approximately a mass per area of 150 g/m$^2$; above that the needle process is more cost-effective. The fleece production process by means of liquid jet is known for example from FR 1 460 513. The jet installation 60 comprises two rows of injection nozzles 61 which act with high pressure upon the front side and the back side of the fiber fleece 51 thus generating the random-fiber fleece. Depending on the desired bonding strength, a single row of nozzles may suffice. The openings of the injection nozzle 61 can have a diameter of approximately 80 to 140×10$^{-6}$ m and are fed with water having a pressure between approximately 5 and 230 bars. The nozzles are disposed perpendicularly to the fiber fleece 51 placed on a metal sieve 62. In order to drain excess water from the fiber fleece 51, below the metal sieve 62 opposing the injection nozzles 61, suction mechanisms 63 are disposed. The water jets penetrate the fiber fleece 51 and interlace the fibers with one another to form a formed solid area body. In this process, a fleece having a preproduction thickness of 2 cm, may be densified to form a 1 mm thick fleece 11. The thickness can be reduced in the random-fiber fleece forming process in a ratio of approximately 10:1 to 50:1. The possible thicknesses of a fleece 11 usable within the scope of the present invention fall between approximately 0.3 and 5 mm. The dramatic reduction of the thickness leads to a marked increase of the density of the fleece 11, which subsequently is for example between approximately 0.1 and 0.5 g/cm$^3$. In addition to the mass per area of the fiber material, density is also significantly affected by the jet pressure. The fleece 11 passes subsequently through the dryer 70 in which the remaining moisture is removed. The dryer 70 can be a hot-air fan, drum, high frequency or microwave dryer. After being dried, the fleece 11 is rolled up with the winder 80.

As an example, process parameters are specified below in detail for the production of a fleece 11 for tools comprising 100% viscose with a mass per area of 200 g/m$^2$ and 1.7 dtex fibers:

carding:
- production of three fiber card webs at 140+120+90 g/m$^2$ and jet bonding:
- first side: pressure of 70 bars
- second side: pressure of 110 bars.

The fleece 11 produced with the above specifications has exceptional mechanical properties. The fleece 11 can be processed like a conventional textile.

The tools forming the subject matter of this invention are produced using the novel fleece material. The production process is simplified since the step of biasing is omitted. Tools of high quality are formed since the random-fiber fleece produced and used according to the invention has good capabilities for taking up grinding paste and durable grinding paste adhesion capability. The surface quality achieved with such tools are improved because hard bias seams are absent. The service life is increased due to uniform low wear.

Figure 2A:
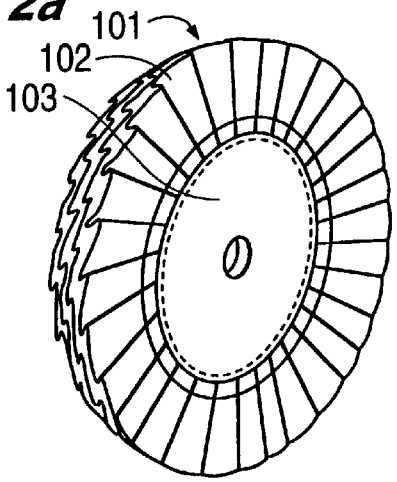
Figure 2B:
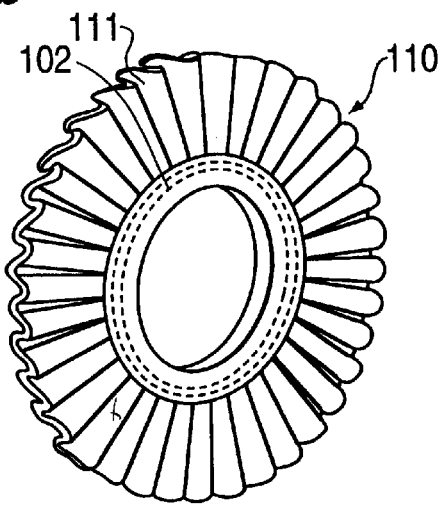
Figure 2C:
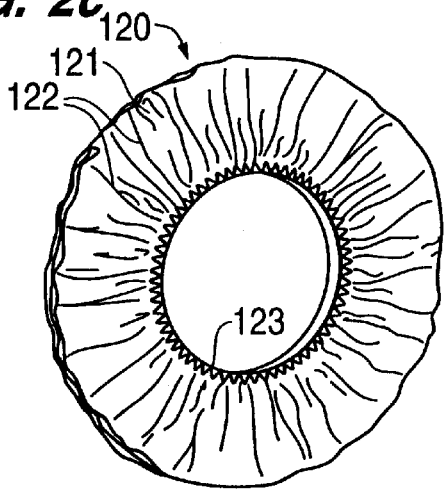
Figure 2D:
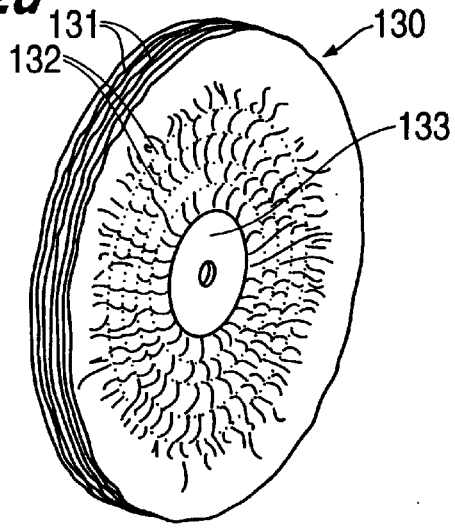
Figure 2E:
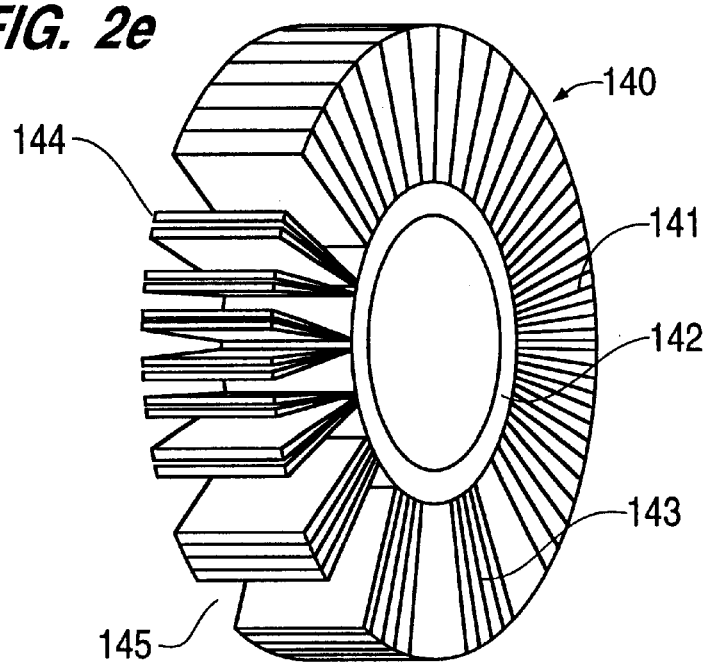
Figure 2F:
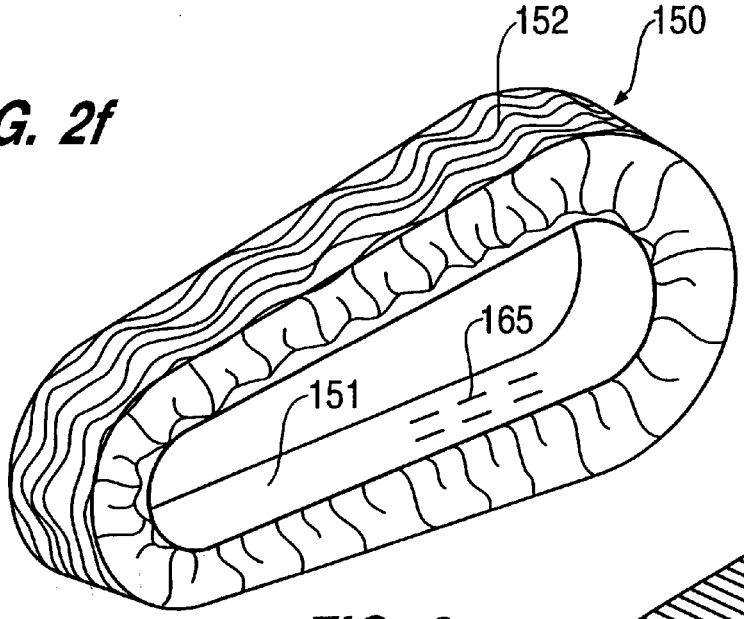
Figure 2G:
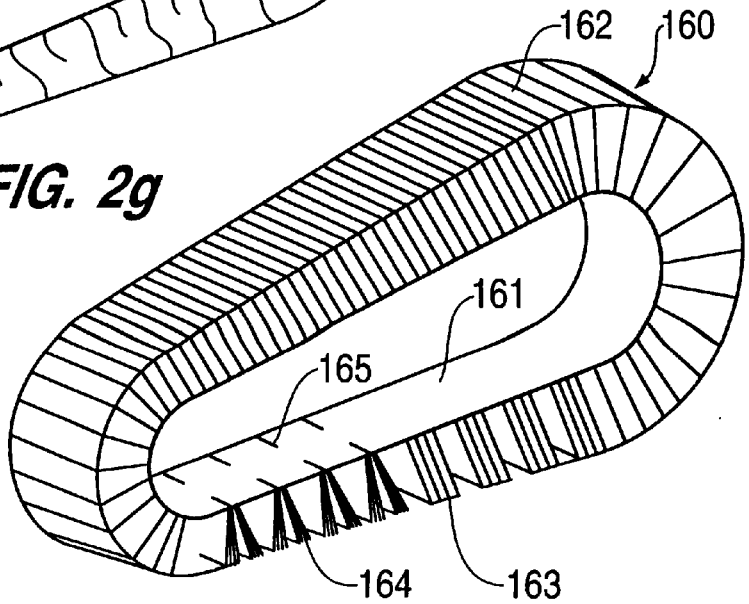

FIGS. 2*a* to *g* show different tools in folded ring form (FIGS. 2*a* to *c*), in flat disk form (FIG. 2*d*), in leaf disk form (FIG. 2*e*), and in web form (FIGS. 2*f* and 2*g*). A ring 101 (FIG. 2*a*) comprises a folded fleece strip 102 which is placed flat in several layers about a core and secured with two cardboard flanges 103. This example is noted for its high adaptation ability to various contours of the item to be worked, effective self-ventilation when rotated, good surface attack and optimum envelopment. The folded ring 110 shown in FIG. 2*b* is fabricated of several superjacent fleece strips 111 folded in the form of waves, which are placed about a core and secured between two cardboard rings 112. This example has good dimensional stability and high strength. The folded ring 120 depicted in FIG. 2*c* comprises a fleece strip 121 which is wound in several layers and gathered by constriction as well as fixed with a clamping ring with metal hook 123. This example has good self-ventilation, high dimensional stability and effective surface attack. The flat disk 130 depicted in FIG. 2*d* comprises two individual disks 131 cut to size, which are placed one on top of the other and connected by means of concentric quilting seams 132. The center is reinforced by a cardboard flange 133 sewn or affixed thereon.

The tool 140 depicted in FIG. 2*e* comprises individual fleece leaves 141 which are fastened on one side of a round, cylindrical, conical or plate-form core 142 preferably by gluing but also by quilting or riveting individually or in packets 143. In addition, the fleece leaves can also be folded in the form of a U 144 and be disposed with or without an interval 145 between them.

The tools 150 and 160 depicted in FIGS. 2*f* and 2*g* comprise a belt-form continuous support 151 or 161 respectively, on which a fleece strip 152 folded into several layers (FIG. 2*f*), individual fleece leaves 162 or fleece leaf packets 163 which can also be folded in the form of a U 164, are fastened by quilting 165, gluing, or riveting (FIG. 2*g*).

Figure 3A:
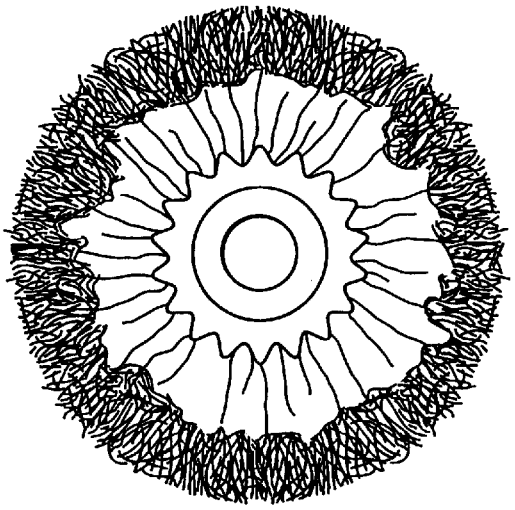
Figure 3B:
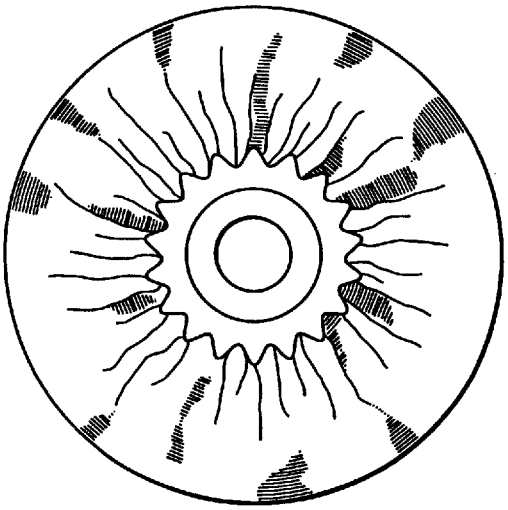

FIGS. 3*a* and 3*b* show two polishing rings after they have been used. Both rings have the configuration of FIG. 2*c*. The first (FIG. 3*a*) has been fabricated conventionally from a cotton textile and the second (FIG. 3*b*) from a cotton fleece according to the invention. Noticeable is the uniform radial wear of the second ring in comparison with the first. In a random-fiber fleece produced by means of needling or liquid jet the radial wear is uniform in contrast to a woven material. Due to this property the second ring can be used for a longer time than the first whose irregular frayed contour impairs its polishing quality.

Figure 4A:
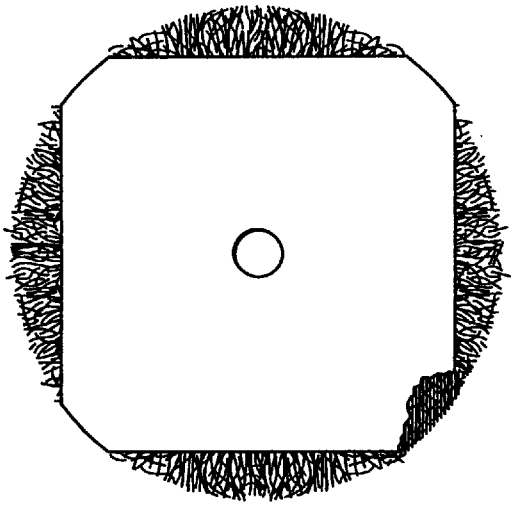
Figure 4B:
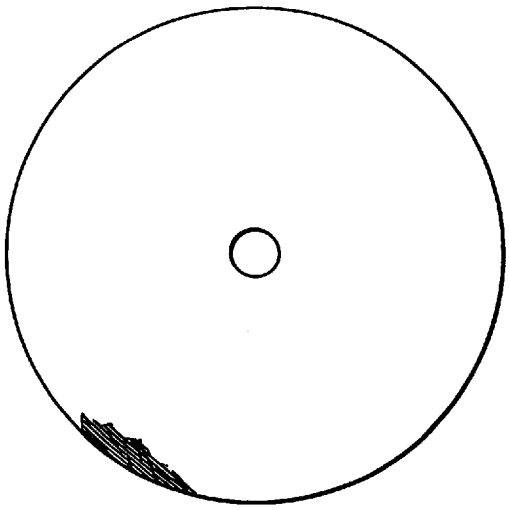

These different characteristics are also evident in FIGS. 4*a* and 4*b* which show two used layers of a multi-layer flat disk according to FIG. 2*d*. The first layer (FIG. 4*a*) was produced in a conventional manner from cotton textiles while the second layer (FIG. 4*b*) was formed according to the invention from a cotton fleece. It is evident that the first layer (FIG. 4*a*) shows marked evidence of wear in the form of strong fraying which leads to a complete change of geometry while the second layer (FIG. 4*b*) shows only light regular fraying.

The invention is not limited to the embodiments described and shown as examples, but can be variously modified within the scope of expert knowledge without deviating from the inventive concept.

I claim:

1. A tool for a mechanical surface treatment of an object by friction, said tool comprising:

a cut-to-size and processed fleece of fibers produced by exclusively mechanical processes as a flexible random-fiber fleece permitting, during treatment of the object at a treatment pressure, immersion and at least partial envelopment of the object, said fleece having a mechanical strength of 150–500 N/50 mm, and a mean elongation at rupture of 50–150% according to DIN 53 857/2.

2. The tool of claim 1, wherein:

said mechanical strength is at least 300 N/50 mm and said mean elongation at rupture is 80–100% according to DIN 53 857/2.

3. The tool of claim 1, wherein:

said fleece has a drop capability of approximately 70–90%.

4. The tool of claim 1, wherein:

said fleece is produced through a mechanical bonding process utilizing a device selected from the group consisting of: a needle machine, a liquid jet installation, a gas jet installation, a water jet installation, and an air jet installation.

5. The tool of claim 1, wherein:

said fleece comprises mineral-containing fibers selected from the group consisting of: natural fibers, artificial fibers, and synthetic fibers and from the group consisting of: mixed fibers and non-mixed fibers.

6. The tool of claim 1, wherein:

said fleece comprises bond fibers bonded together at cross-over points by thermofixation.

7. The tool of claim 1, wherein:

said fleece comprises shrink fibers contracted by heat, which remain contracted after the heating and a subsequent cooling.

8. The tool of claim 1, wherein:

said fleece comprises cross-cut fibers having a length of approximately 10–100 mm and a titer of 0.02–150 dtex.

9. The tool of claim 1, wherein:

said fleece is produced by a liquid jet which applies liquid at a pressure of approximately 5–230 bars, thereby affecting a density and a thickness of said fleece.

10. The tool of claim 1, wherein:

said fleece is produced by a liquid jet which has a plurality of nozzles;

each of said nozzle has a diameter of approximately $80–140\times10^{-6}$ m.

11. The tool of claim 1, wherein:

said fleece has a mass per area of approximately 50–500 $g/m^2$.

12. The tool of claim 1, wherein:

said fleece has a density of approximately 0.1–0.5 $g/cm^3$.

13. The tool of claim 1, wherein:

said fleece has a thickness of approximately 0.3–5.0 mm.

14. The tool of claim 1, wherein:

said fleece is arranged as at least one layer and as a device selected from the group consisting of: a folded ring, a flat disk, a pad, a roll, a cylinder, a tape, and a brush.

15. The tool of claim 1, further comprising:

a solid core;

wherein at least one folded ring-shaped layer of said fleece is secured about an outer periphery of said solid core.

16. The tool of claim 1, further comprising:

a solid core;

wherein at least one ring-shaped layer of said fleece, folded in a wave-like form, is secured about an outer periphery of said solid core.

17. The tool of claim 1, wherein:

at least one ring-shaped layer of said fleece is gathered and held together at an inner periphery thereof by a clamping ring.

18. The tool of claim 1, wherein:

at least two coaxially aligned disk-shaped layers of said fleece are held together by a device selected from the group consisting of: a cardboard flange and a quilted seam.

19. The tool of claim 1, further comprising:

a round core;

wherein a plurality of strip-shaped segments of said fleece, formed as at least one layer into leaves, is fastened onto said round core.

20. The tool of claim 1, further comprising:

a cylindrical core;

wherein a plurality of strip-shaped segments of said fleece, formed as at least one layer into leaves, is fastened onto said cylindrical core.

21. The tool of claim 1, further comprising:

a conical core;

wherein a plurality of strip-shaped segments of said fleece, formed as at least one layer into leaves, is fastened onto said conical core.

22. The tool of claim 1, further comprising:

a plate-shaped core;

wherein a plurality of strip-shaped segments of said fleece, formed as at least one layer into leaves, is fastened onto said plate-shaped core.

23. The tool of claim 1, further comprising:

a continuous belt to be driven by pulleys;

wherein at least one strip of said fleece, folded in several layers, is fastened onto said continuous belt.

24. The tool of claim 1, further comprising:

a continuous belt;

wherein a plurality of strip-shaped segments of said fleece, formed as at least one layer into leaves, is fastened onto said continuous belt.

25. The tool of claim 1, further comprising:

a substance, which does not affect the mechanical bonding of fibers of said fleece, provided in said fleece for providing a characteristic selected from the group consisting of: reducing wear, reducing flammability, improving paste adhesion, improving abrasive behavior, improving surface attack, improving service life, improving liquid absorption, improving liquid repelling capability, and improving anti-static effect.

* * * * *